US007054752B2

(12) United States Patent
Zabalza-Mezghani et al.

(10) Patent No.: US 7,054,752 B2
(45) Date of Patent: May 30, 2006

(54) METHOD FOR OPTIMIZING PRODUCTION OF AN OIL RESERVOIR IN THE PRESENCE OF UNCERTAINTIES

(75) Inventors: Isabelle Zabalza-Mezghani, Rueil Malmaison (FR); Emmanuel Manceau, Rueil Malmaison (FR); Mathieu Feraille, Nanterre (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 44 days.

(21) Appl. No.: 10/857,945

(22) Filed: Jun. 2, 2004

(65) Prior Publication Data

US 2004/0254734 A1 Dec. 16, 2004

(30) Foreign Application Priority Data

Jun. 2, 2003 (FR) ..... 03 06637

(51) Int. Cl.
*G01V 9/00* (2006.01)

(52) U.S. Cl. ..... 702/13; 703/10

(58) Field of Classification Search ..... 702/2, 702/6, 12, 13; 703/10; 705/7, 11
See application file for complete search history.

(56) References Cited

U.S. PATENT DOCUMENTS

| | | | | |
|---|---|---|---|---|
| 5,216,917 | A * | 6/1993 | Detournay | 73/152.59 |
| 5,444,619 | A * | 8/1995 | Hoskins et al. | 702/13 |
| 5,992,519 | A * | 11/1999 | Ramakrishnan et al. | 166/250.15 |
| 6,519,854 | B1 * | 2/2003 | Blank | 29/897.1 |
| 6,836,731 | B1 * | 12/2004 | Whalley et al. | 702/13 |
| 6,980,940 | B1 * | 12/2005 | Gurpinar et al. | 703/10 |

* cited by examiner

*Primary Examiner*—Donald McElheny, Jr.
(74) *Attorney, Agent, or Firm*—Antonelli, Terry, Stout and Kraus, LLP.

(57) ABSTRACT

A method for optimizing the production of oil reservoirs, and notably the production schemes, while taking into account uncertainties inherent in any reservoir survey. The method sequentially has the following stages:

Stage 1: A sensitivity study to evaluate the impact, on the production of the oil reservoir, of the production scheme configurations tested (several well sites, . . . ) in relation to the uncertainties specific to the reservoir (permeability, aquifer force, . . . ).

Stage 2: A quantification study of the risks associated with the configurations being studied to determine whether it is necessary to seek an optimum production scheme.

Stage 4: A production scheme optimization study: having, the goal to determine the ideal production configuration for a given objective.

36 Claims, 4 Drawing Sheets

METHOD FOR OPTIMIZING PRODUCTION OF AN OIL RESERVOIR IN THE PRESENCE OF UNCERTAINTIES

BACKGROUND OF THE INVENTION

1. Field of the Invention

The present invention allows study and/or optimizing a production scheme for an oil reservoir. It evaluates the risks taken in terms of the development scheme, to compare several schemes, and to define an optimum scheme considering a given production criterion, for example oil recovery maximization, water recovery minimization or maintenance of the production rate at a given value for a given period. The present invention optimizes a production scheme in a probabilistic context. In fact, optimization is carried out by taking account of the uncertainties inherent in the reservoir.

2. Description of the Prior Art

Optimization of the production scheme is currently carried out according to two approaches:

by comparing each production scenario discretely, which is for example the case with the "nested simulation" [1] or "decision tree" [2] type approaches. This approach affords the advantage of combining several development options, but its cost in terms of numerical simulation is very high. Furthermore, it does not allow integration of uncontrollable uncertainties inherent in the reservoir (permeability, porosity);

by determining the optimum production configuration for a given reservoir while disregarding any form of uncertainty. Such studies using experimental designs have allowed providing an optimum production scheme, but by putting forward the strong hypothesis that there is no uncertainty on the geologic, static or dynamic of the reservoir [3].

[1] [2] Ian Colins, "Decision Tree Analysis and Simple Economic Models Identify Technical Option Raking and Project Cost Estimates for Full Field Case", WordOil, pp. 62–69, May 2003.

[3] Dejean, J. P. and Blanc, G., "Managing Uncertainties on Production Predictions Using Integrated Statistical Methods", SPE 56696, SPE Annual Technical Conference and Exhibition, Houston, USA, Oct. 3–6, 1999.

Production scheme optimization is a very interesting problem because its goal is better management (in terms of cost, profit, safety, respect for environment) of the production of oil reservoirs. The method according to the invention allows studying production scheme optimization in a more general context than the context used so far : it allows optimization while integrating the various sources of uncertainty of the reservoir.

SUMMARY OF THE INVENTION

In general terms, the invention provides a method for optimizing, in an uncertain context, a production criterion of an oil reservoir modelled by a flow simulator, wherein the following stages are carried out:

a) selecting at least one parameter intrinsic to the reservoir and at least one parameter related to the reservoir development options, the parameters having an influence on the hydrocarbon production of the reservoir;

b) determining an analytic model expressing the production criterion of the reservoir in the course of time as a function of the parameters selected in stage a), by taking account of a finite number of values of the production criterion, the values being obtained by the flow simulator; and c) from the analytic model determined in stage b), associating an uncertainty law with at least one of the parameters intrinsic to the reservoir and determining a distribution of at least one of the parameters related to the reservoir development options so as to optimize the production criterion.

Before stage c), the relative influence of the parameters in relation to one another can be quantified and the parameters having a negligible influence on the reservoir production criterion in the course of time can be eliminated. The relative influence of the parameters in relation to one another can be quantified by means of a statistical test (Student or Fisher test for example).

In stage c), the value of at least one of said parameters intrinsic to the reservoir can be fixed and the value of at least one of the parameters related to the reservoir development options can be determined so as to optimize the production criterion.

The following stages can be carried out in stage c): i) randomly drawing several values of at least one of the parameters intrinsic to the reservoir according to its uncertainty law, ii) determining the values of at least one of the parameters related to the reservoir development options so as to optimize the production criterion for each value drawn in stage i), iii) from the values determined in stage ii), the optimum distribution of the parameters related to the reservoir development options is obtained.

In stage b), the analytic model can be determined using an experimental design, each experiment simulation of simulating the oil reservoir by the flow simulator. In stage b), the analytic model can also be determined using neural networks.

In stage a), the at least one parameter intrinsic to the reservoir can be of discrete, continuous and/or stochastic type.

The method according to the invention can be applied whatever the state of development of the field (appraisal, mature fields . . . ).

BRIEF DESCRIPTION OF THE DRAWINGS

Other features and advantages of the invention will be clear from reading the description hereafter, with reference to the accompanying drawings wherein.

DETAILED DESCRIPTION OF THE INVENTION

A reservoir is considered having 5 porous and permeable layers, numbered 1 to 5 from the top. Layers 1, 2, 3 and 5 have good petrophysical qualities whereas layer 4 is of bad quality. This reservoir is developed by means of 5 producing wells.

Figure 1:
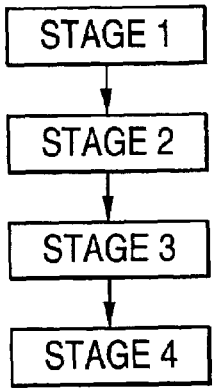
FIG. 1 diagrammatically shows the method according to the invention.

The invention is diagrammatically illustrated in FIG. 1.

Stage 1: Determination of the Uncertain Parameters and of the Development Options The first stage of the method according to the invention selects uncertain technical parameters linked with the reservoir under consideration and having an influence on the hydrocarbon or water production profiles of the reservoir.

Uncertain parameters intrinsic to the reservoir are selected. For example, the following parameters can be considered:

a permeability multiplier for layers 1, 2, 3 and 5: MPH1 the force of the aquifer: AQUI the residual oil saturation after water sweep: SORW.

Each one of these parameters is uncertain and can have a significant impact on the production profiles. The method according to the invention allows quantification to the extent the uncertainty on these parameters has an impact on the twelve-year production predictions. A probable variation range is associated with each parameter:

$MPH1 \in [MPH1_{min}, MPH1_{max}]=[0.8; 1.2]$ $AQUI \in [AQUI_{min}, AQUI_{max}]=[0.2; 0.3]$ $SORW \in \{SORW_{min}, SORW_{max}]=[0.15; 0.25]$.

For optimization of a production scheme, parameters corresponding to reservoir development options that might influence the production are selected. These parameters can be: the position of a well, the completion level, the drilling technique, etc. In terms of production, the twelve-year production behavior is examined.

For example, the production scheme to be tested and optimized adds a new well P1. The parameters that are to be optimized are:

the position of the well along axis x: $P1X \in [P1X_{min}, P1X_{max}]=[6; 11]$ the position of the well along axis y: $P1Y \in [P1Y_{min}, P1Y_{max}]=[21; 23]$.

According to the example selected, five uncertain parameters are considered: three parameters intrinsic to the reservoir and two parameters used for optimization of a production criterion.

According to the invention, the parameters dedicated to the development scheme actually influence the production considering the presence of the other uncertainties can be checked. In fact, it is possible that the uncertainty on one of the parameters intrinsic to the reservoir is such that the various development options have a negligible impact on the production, considering the predominant uncertainty.

A joint sensitivity analysis that is including the uncertain parameters intrinsic to the reservoir and the production parameters, is carried out. The aforementioned experimental design method [3] can be used therefore. The basic principle of this theory has knowledge of the variation ranges of the parameters studied, in recommending a series of simulations allowing evaluation of the sensitivity to the various parameters of the twelve-year cumulative production. For example, sixteen flow simulations are carried out to obtain an analytic modelling of the behavior of the twelve-year cumulative hydrocarbon production as a function of the five parameters studied.

Figure 2:
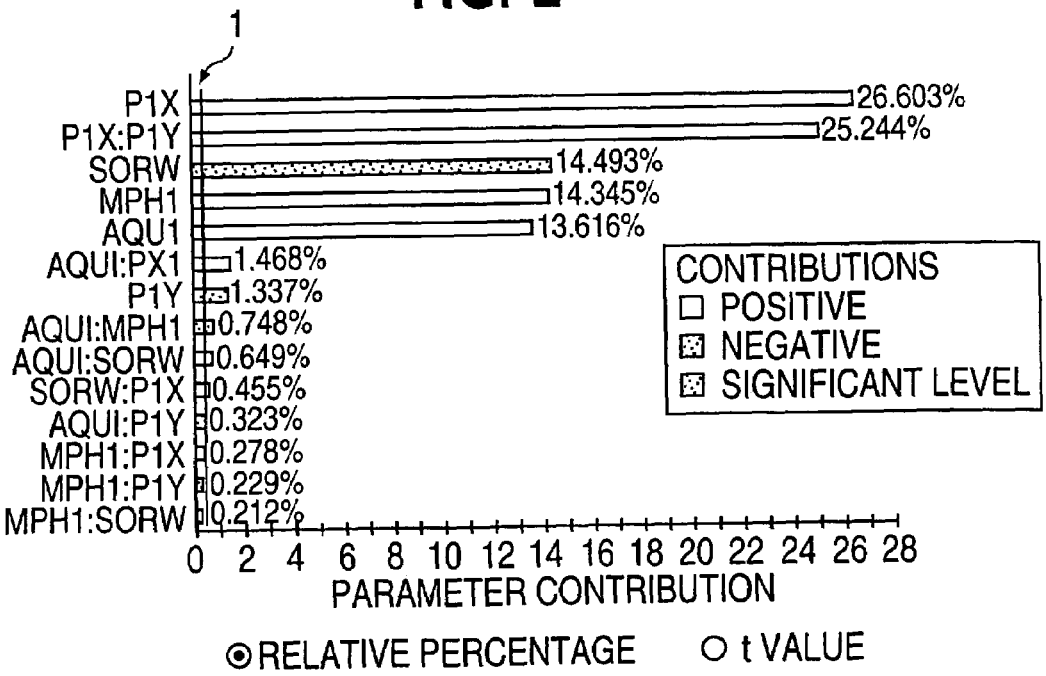
FIG. 2 shows a Pareto diagram.

A statistical test, a Student test for example, is then applied to test the influence of each parameter of the analytic model. A Pareto diagram shown in FIG. 2, which specifies the respective influence of the uncertainty of each parameter on the twelve-year cumulative hydrocarbon production, is thus obtained. The terms on the right of line 1 are influential whereas those on the left are negligible. The analytic model can be simplified by eliminating the negligible terms. A better diagnosis of the influence of the development options selection in relation to the uncertainties intrinsic to the reservoir is thus obtained.

The negligible terms can be eliminated according to the Student test diagnosis by successive iterations. The simplified model obtained after the removals actually highlights the preponderant impacts on the production response. It can therefore be observed that the uncertainties intrinsic to the reservoir are influential but that the development option is also essential through terms P1X, P1X: P1Y, AQUI: P1X and P1Y.

These results therefore confirm that it is necessary to consider studying the development scheme options in the presence of uncertainties on the parameters related to the reservoir, as well as optimizing the location of well P1 in order to optimize the hydrocarbon or water recovery while taking account of the other uncertainties.

Stage 2: Flow Simulator Approximation

The oil reservoir is modelled by means of a numerical reservoir simulator. The reservoir simulator or flow simulator notably allows calculating of the production of hydrocarbons or water in the course of time as a function of technical parameters such as the number of layers of the reservoir, the permeability of the layers, the aquifer force, the position of the oil well, etc.

An analytic model expressing a production criterion studied in the course of time is determined from a finite number of values previously obtained by means of the flow simulator. The simulations are carried out by varying the different parameters selected in stage 1. The analytic model can be determined by means of mathematical methods such as experimental designs, neural networks, etc.

In cases where the experimental design method is used, according to the type and to the number of uncertain parameters selected in stage 1, there are suitable experimental designs defining a number of numerical simulations to be carried out in order to characterize the uncertain domain in a rigorous and homogeneous manner. It is thus possible to rapidly and correctly analyse the influence of each uncertain parameter. It is possible to use the experimental designs described in the aforementioned document [3].

From the numerical simulation results, and using statistical methods, it is possible to relate the production of hydrocarbons or water in the course of time by one or more analytic functions to the uncertain technical parameters. The form of the analytic function(s) depends on the experimental design selected and on the type of parameters.

Using mathematical methods such as experimental designs, neural networks, and using suitable statistical tools has the advantage of replacing the flow simulator, very costly in calculating time, by one or more very fast analytic functions, valid on the uncertain domain, allowing transcribing the evolution of a production response as a function of the uncertain parameters. Furthermore, it is important to note that the analytic functions defined do not depend on the probability density of the uncertain parameters but only on their upper and lower boundaries.

It is thus possible to replace by several analytic functions the production profile of a reservoir, which just requires determination of the analytic functions giving the hydrocarbon production as a function of the technical parameters, for each production profile year.

In our example, we are going to determine polynomial functions allowing relating the cumulative hydrocarbon production for each one of the twelve years of the production profile to the five deterministic uncertain parameters defined in stage 1. An experimental design of order 2 suited to five deterministic parameters having the characteristics described in Table 1 and allowing taking account of the terms described in Table 2 is selected.

TABLE 1

| Characteristics of the experimental design Design properties | |
|---|---|
| Design type | Central Composite - Face Centered |
| Number of parameters | 5 |
| Number of simulations | 27 |

TABLE 2

| Terms taken into account in the analytic model | | |
|---|---|---|
| Main | Interactions | Quadratic |
| MPH1 | MPH1:SORW | MPH1^2 |
| SORW | MPH1:AQUI | SORW^2 |
| AQUI | MPH1:P1X | AQUI^2 |
| P1X | MPH1:P1Y | P1X^2 |
| P1Y | SORW:AQUI | P1Y^2 |
| | SORW:P1X | |
| | SORW:P1Y | |
| | AQUI:P1X | |
| | AQUI:P1Y | |
| | P1X:P1Y | |

The twenty-seven simulations associated with the experimental design considered were carried out in order to obtain twenty-seven simulated results for the cumulative hydrocarbon production for the twelfth production year. From these results, a polynomial model was constructed, using the statistical response surface method, in order to approach the flow simulator on the uncertain domain for the twelfth production year.

Stage 3: Risk Analysis by Uncertain Parameters and Development Options

Figure 3:
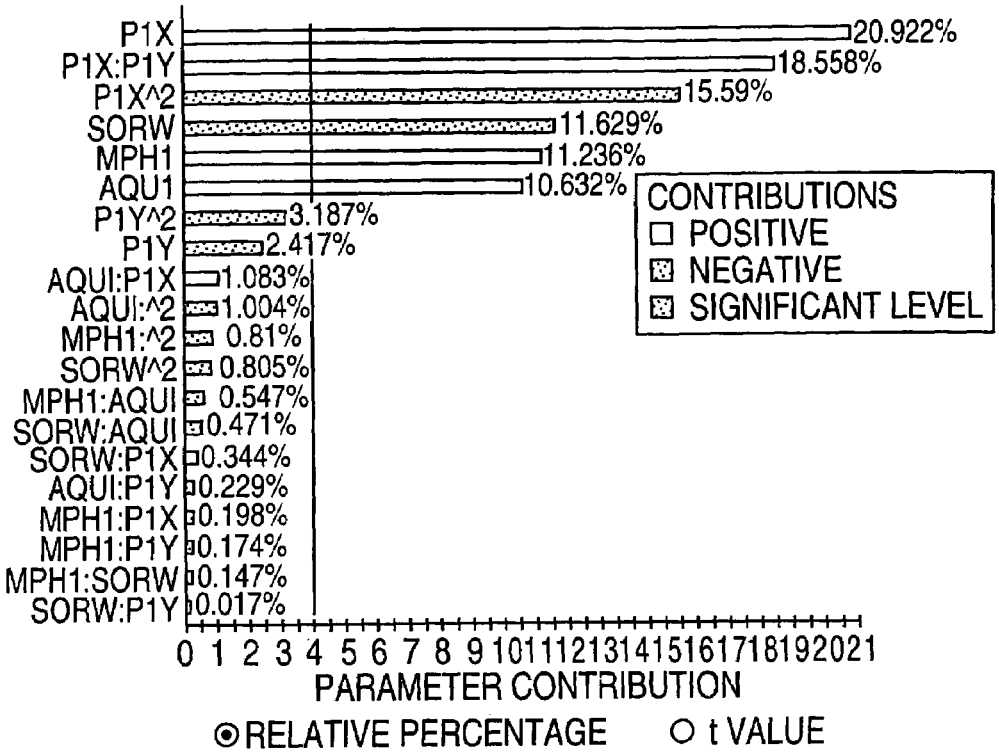
FIG. 3 shows a Pareto diagram.

A statistical test, a Student or Fisher test for example, can be applied to test the influence of each parameter of the analytic model. A Pareto diagram is thus obtained, as shown in FIG. 3, which specifies the respective influence of the uncertainty of each parameter on the twelve-year cumulative hydrocarbon production.

The negligible terms can be eliminated by successive iterations according to the Student test diagnosis. The new simplified model actually highlights the preponderant impacts on the production response. It can therefore be observed that the uncertainties on the parameters intrinsic to the reservoir are influential but that the development option is also essential through terms P1X, P1X: P1Y, AQUI: P1X, P1Y, as well as P1$X^2$ and P1$Y^2$.

A quantitative diagnosis can be obtained by means of the analytic model (of order 2). In fact, it is important to check that this model accurately retranscribes the simulated values and that it can also be used reliably for twelve-year cumulative hydrocarbon production predictions at other points than those simulated. It is therefore possible to use calculation of a statistical criterion allowing evaluation of the quality of the adjustment and of the predictivity of the analytic model.

Consequently, the analytic model allows carrying out prediction calculations of the twelve-year cumulative hydrocarbon production at any point of the uncertain domain, without requiring the flow simulator.

It is thus possible to estimate the probabilized distribution of the cumulative hydrocarbon distribution by assigning a distribution law to each uncertain parameter and to each parameter corresponding to the development options taken into account by the analytic model:

MPH1 follows a normal law of average 1.0 and of standard deviation 0.1,

AQUI follows a uniform law between 0.2 and 0.3

SORW follows a normal law of average 0.2 and of standard deviation 0.016.

The development options, here the locations of wells P1X and P1Y, are assumed to follow a uniform law in their variation domain since there is no reason to favor one option in relation to another.

Figure 4:
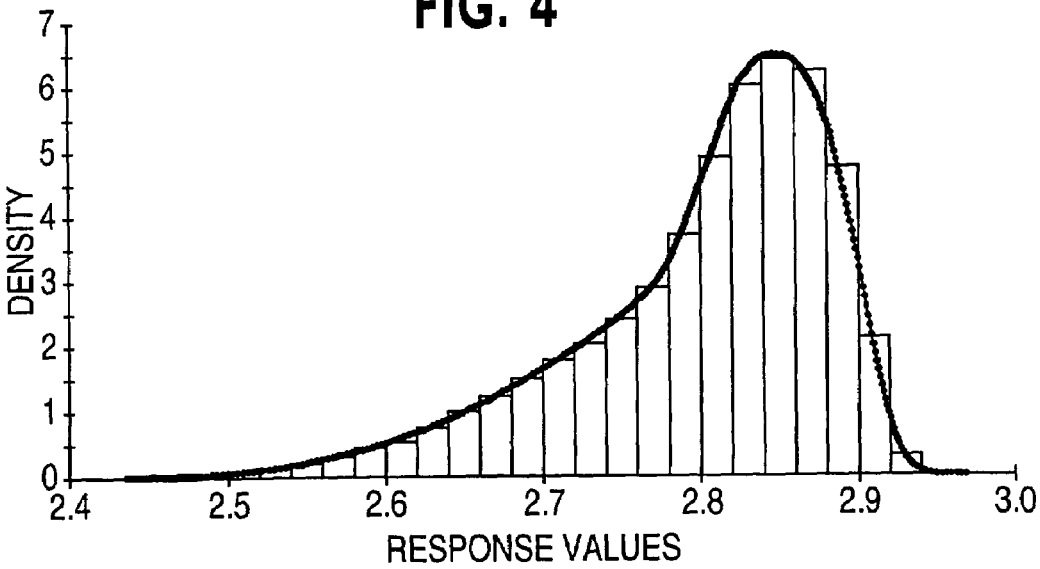
FIG. 4 shows the variability of the twelve-year cumulative hydrocarbon production and before optimization of the development scheme.

After sampling, for example according to the Monte Carlo method, we obtain the probability distribution of the twelve-year cumulative hydrocarbon production expressing the impact of the uncertainty on the parameters and the development options (FIG. 4) is obtained. Considering the uncertainties intrinsic to the reservoir and the various development options, the twelve-year cumulative oil estimation ranges between 2.4 and 3.0 million $m^3$ is observed. This variation then justifies the decision to optimize the development scheme to reduce this uncertainty on the hydrocarbon recovery and hope to maximize the production.

Stage 4: Optimization of a Development Scheme

Optimization of a development scheme determines the options of the production scheme of the reservoir (well type, well location, completion positioning, recovery type . . . ) allowing best hydrocarbon or water recovery.

For example, optimization allows defining the optimum position of well P1 to maximize the twelve-year cumulative hydrocarbon recovery. This optimization can be carried out in two ways: deterministic or probabilistic.

Deterministic Optimization

Deterministic optimization consists in fixing fixes each uncertain parameter at a given value (which seems the most probable) and seeks in the now deterministic context (the uncertainties being then removed) the values of P1X and P1Y which maximize the 12-year oil cumulative production. The numerical optimization results are $$P1X^{Opt}=9.18,\ P1Y^{Opt}=22.15 \text{ and } Cumoil^{Opt}=2.889\ MM^3.$$

Probabilistic Optimization

Probabilistic optimization is a generalization of the deterministic optimization insofar as it does not restrict the uncertain parameters to a probable value but integrates all their random character.

Each uncertain parameter therefore keeps its probability distribution (as in the sampling stage) and the development options that maximize production are determined in this probabilistic context.

More precisely, a random draw is carried out according to each law selected:

MPH1: drawing 1000 realizations of a normal law of average 1 and of standard deviation 0.1, AQUI: drawing 1000 realizations of a uniform law between 0.2 and 0.3, SORW: drawing 1000 realizations of a normal law of average 0.2 and of standard deviation 0.016.

This sampling stage thus allows translating the random and uncertain nature of these parameters. By considering these three uncertainties via their draw, there are 1000 triplets of realizations of MPH1, AQUI and SORW.

Figure 5:
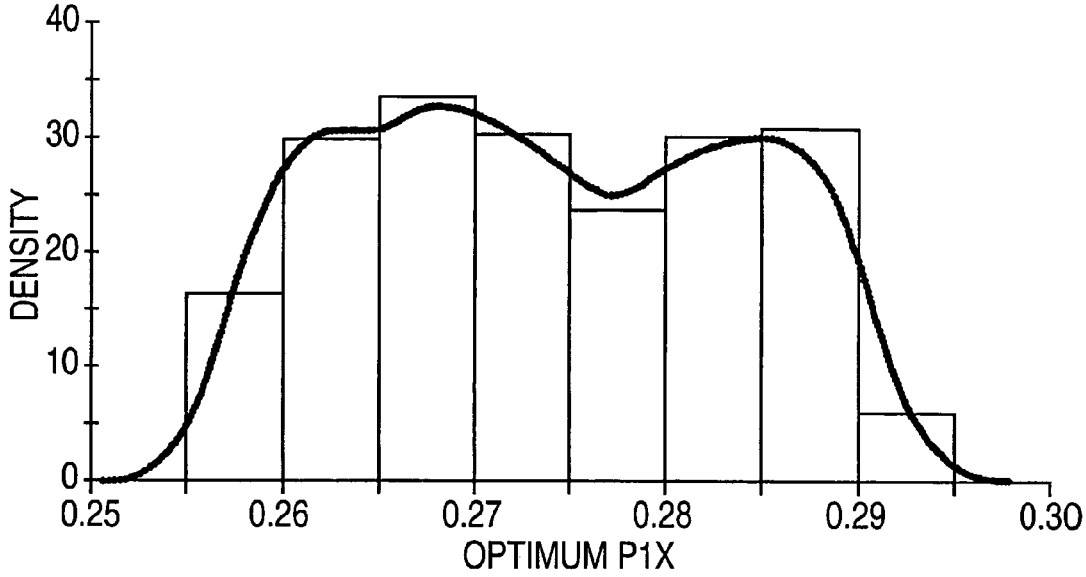
FIG. 5 shows the optimum distribution of well P1 along the x-axis.
Figure 6:
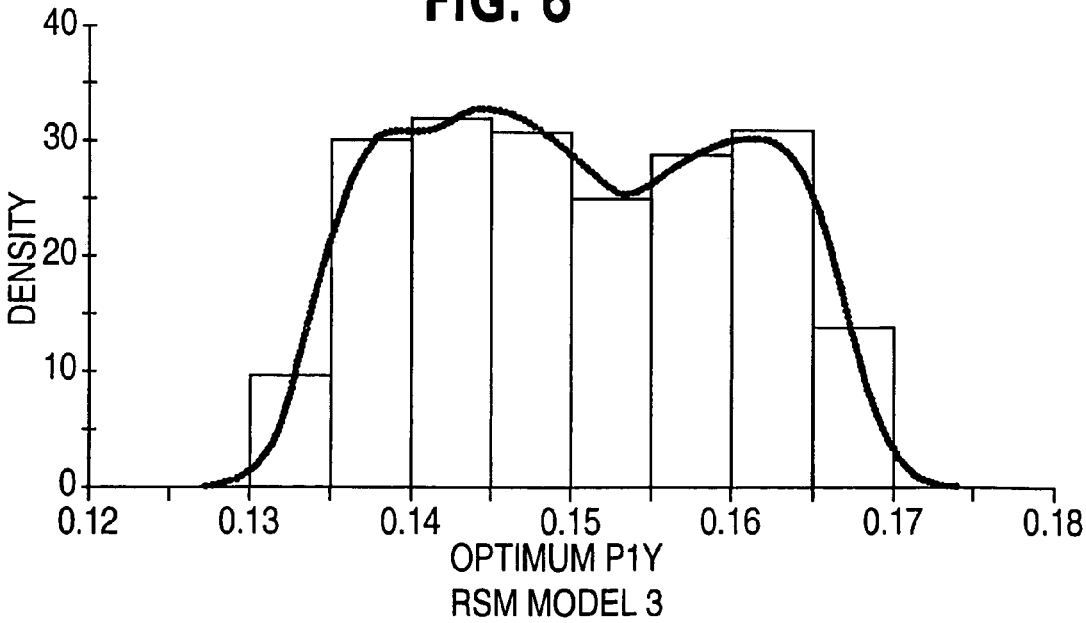
FIG. 6 shows the optimum distribution of well P1 along the y-axis.

Each triplet is then used to determine the corresponding optimum well position which allows maximizing a production criterion. For example, after this multiple optimization 1000 optimum values of P1X, P1Y and of the twelve-year maximum cumulative oil production is obtained. In this context, the optimum development scheme is no longer the only scheme and it perfectly integrates the uncertainty intrinsic to the reservoir. FIG. 5 shows the optimum distribution of well P1 along the x-axis, considering the existing uncertainty (the values of x are given in normalized value between [−1,1]). Similarly, FIG. 6 shows the optimum distribution of well P1 along the y-axis, considering the existing uncertainty (the values of y are given in normalized value between [−1,1]).

The optimum distributions of P1X and P1Y show that the uncertain parameters intrinsic to the reservoir have an impact on the decision making of the development scheme. In this case, it is necessary to:

- either reduce the uncertainties on these parameters, for example by carrying out new acquisition programs,
- or to select one of the probable optimum values, generally the values forming the probability maximum.

Figure 7:
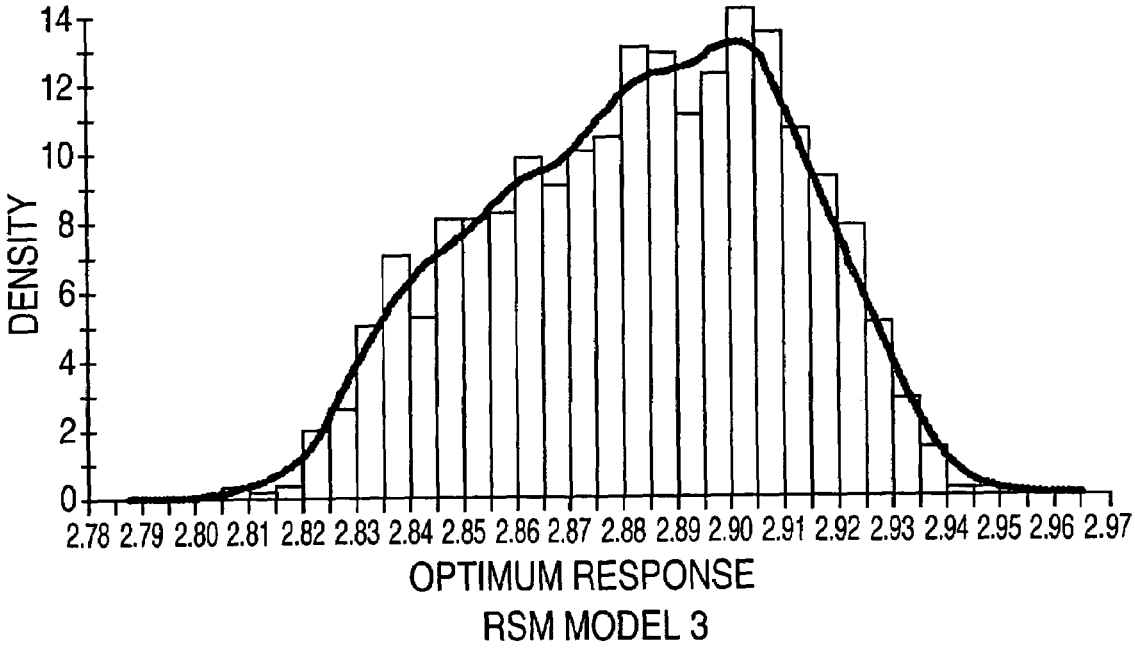
FIG. 7 shows the residual variability of the twelve-year cumulative hydrocarbon production and after optimization of the development scheme.

Finally, FIG. 7 shows the residual variability of the twelve-year cumulative hydrocarbon production in the context of an optimum development scheme but in the presence of reservoir uncertainties that cannot be controlled. In this precise context, the optimum solution corresponds to a well site located at cell 9 (0.27 in normalized) along the x-axis and cell 22 (014 in normalized) along the y-axis.

On the other hand, it appears that the development scheme optimization has allowed reduction of the uncertainty on the 12-year oil cumulative production predictions: the oil cumulative estimation ranges between 2.8 and 2.95 million $m^3$ and no longer between 2.4 and 3.0 million $m^3$ as before.

The invention claimed is:

1. A method for optimizing, in an uncertain context, a production criterion of an oil reservoir modelled by a flow simulator, comprising the steps:

a) selecting at least one parameter intrinsic to the reservoir and at least one parameter related to reservoir development options, the parameters having an influence on the hydrocarbon production of the reservoir;

b) determining an analytic model expressing a production criterion of the reservoir over time as a function of the parameters selected in step a), by taking into account a finite number of values of the production criterion, the values being obtained by the flow simulator; and c) from the analytic model determined in step b), associating an uncertainty law with the at least one of the parameters intrinsic to the reservoir and determining a distribution of the at least one of the parameters related to the reservoir development options so as to optimize the production criterion.

2. A method as claimed in claim 1 wherein, in step c), a relative influence of the parameters in relation to one another is quantified and the parameters having a negligible influence on the production criterion of the reservoir over time are eliminated.

3. A method as claimed in claim 2, wherein a relative influence of the parameters in relation to one another is quantified by means of a statistical test.

4. A method as claimed in claim 3, wherein the statistical test is selected from among Student and Fisher tests.

5. A method as claimed in claim 1 wherein, in step c), a value of the at least one of the parameters intrinsic to the reservoir is fixed and a value of the at least one of the parameters related to the reservoir development options is determined so as to optimize the production criterion.

6. A method as claimed in claim 1 wherein, in step c), the following steps are carried out: i) randomly drawing values of the at least one of the parameters intrinsic to the reservoir according to an uncertainty law thereof, ii) determining values of the at least one of the parameters related to the reservoir development options so as to optimize the production criterion for each value drawn in step i), iii) from the values determined in step ii), an optimum distribution of the parameters related to the reservoir development options is obtained.

7. A method as claimed in claim 1 wherein, in step b), the analytic model is determined using an experimental design, each experiment simulating the oil reservoir carried out by the flow simulator.

8. A method as claimed in claim 1 wherein, in step b), the analytic model is determined using neural networks.

9. A method as claimed in claim 1 wherein, in step a), the at least one parameter intrinsic to the reservoir is at least one of a discrete, continuous and stochastic type.

10. A method as claimed in claim 2 wherein, in step b), the analytic model is determined using an experimental design, each experiment simulating the oil reservoir carried out by the flow simulator.

11. A method as claimed in claim 3 wherein, in step b), the analytic model is determined using an experimental design, each experiment simulating the oil reservoir carried out by the flow simulator.

12. A method as claimed in claim 4 wherein, in step b), the analytic model is determined using an experimental design, each experiment simulating the oil reservoir carried out by the flow simulator.

13. A method as claimed in claim 5 wherein, in step b), the analytic model is determined using an experimental design, each experiment simulating the oil reservoir carried out by the flow simulator.

14. A method as claimed in claim 6 wherein, in step b), the analytic model is determined using an experimental design, each experiment simulating the oil reservoir carried out by the flow simulator.

15. A method as claimed in claim 2 wherein, in step b), the analytic model is determined using neural networks.

16. A method as claimed in claim 3 wherein, in step b), the analytic model is determined using neural networks.

17. A method as claimed in claim 4 wherein, in step b), the analytic model is determined using neural networks.

18. A method as claimed in claim 5 wherein, in step b), the analytic model is determined using neural networks.

19. A method as claimed in claim 6 wherein, in step b), the analytic model is determined using neural networks.

20. A method as claimed in claim 2 wherein, in step a), the at least one parameter intrinsic to the reservoir is at least one of a discrete, continuous and stochastic type.

21. A method as claimed in claim 3 wherein, in step a), the at least one parameter intrinsic to the reservoir is at least one of a discrete, continuous and stochastic type.

22. A method as claimed in claim 4 wherein, in step a), the at least one parameter intrinsic to the reservoir is at least one of a discrete, continuous and stochastic type.

23. A method as claimed in claim 5 wherein, in step a), the at least one parameter intrinsic to the reservoir is at least one of a discrete, continuous and stochastic type.

24. A method as claimed in claim 6 wherein, in step a), the at least one parameter intrinsic to the reservoir is at least one of a discrete, continuous and stochastic type.

25. A method as claimed in claim 7 wherein, in step a), the at least one parameter intrinsic to the reservoir is at least one of a discrete, continuous and stochastic type.

26. A method as claimed in claim 8 wherein, in step a), the at least one parameter intrinsic to the reservoir is at least one of a discrete, continuous and stochastic type.

27. A method as claimed in claim 10 wherein, in step a), the at least one parameter intrinsic to the reservoir is at least one of a discrete, continuous and stochastic type.

28. A method as claimed in claim 11 wherein, in step a), the at least one parameter intrinsic to the reservoir is at least one of a discrete, continuous and stochastic type.

29. A method as claimed in claim 12 wherein, in step a), the at least one parameter intrinsic to the reservoir is at least one of a discrete, continuous and stochastic type.

30. A method as claimed in claim 13 wherein, in step a), the at least one parameter intrinsic to the reservoir is at least one of a discrete, continuous and stochastic type.

31. A method as claimed in claim 14 wherein, in step a), the at least one parameter intrinsic to the reservoir is at least one of a discrete, continuous and stochastic type.

32. A method as claimed in claim 15 wherein, in step a), the at least one parameter intrinsic to the reservoir is at least one of a discrete, continuous and stochastic type.

33. A method as claimed in claim 16 wherein, in step a), the at least one parameter intrinsic to the reservoir is at least one of a discrete, continuous and stochastic type.

34. A method as claimed in claim 17 wherein, in step a), the at least one parameter intrinsic to the reservoir is at least one of a discrete, continuous and stochastic type.

35. A method as claimed in claim 18 wherein, in step a), the at least one parameter intrinsic to the reservoir is at least one of a discrete, continuous and stochastic type.

36. A method as claimed in claim 19 wherein, in step a), the at least one parameter intrinsic to the reservoir is at least one of a discrete, continuous and stochastic type.

* * * * *